US005915996A

United States Patent [19]

Kitamura

[11] Patent Number: 5,915,996

[45] Date of Patent: Jun. 29, 1999

[54] ASSEMBLY OF PLUG AND CAP ELECTRIC CONNECTORS

[75] Inventor: Hiroshi Kitamura, Kawasaki, Japan

[73] Assignee: The Whitaker Corporation, Wilmington, Del.

[21] Appl. No.: 08/863,769

[22] Filed: May 27, 1997

[30] Foreign Application Priority Data

May 30, 1996 [JP] Japan ..... 8-206679

[51] Int. Cl.[6] ..... H01R 13/64

[52] U.S. Cl. ..... 439/680

[58] Field of Search ..... 439/374, 752, 439/378, 680, 681

[56] References Cited

U.S. PATENT DOCUMENTS

| | | | |
|---|---|---|---|
| 4,764,129 | 8/1988 | Jones et al. | 439/680 |
| 5,299,958 | 4/1994 | Ohsumi | 439/752 |
| 5,425,650 | 6/1995 | Maeda | 439/374 |
| 5,785,559 | 7/1998 | Meyer et al. | 439/680 |
| 5,797,772 | 8/1998 | Sakurai et al. | 439/752 |

*Primary Examiner*—Neil Abrams
*Assistant Examiner*—T C Patel
*Attorney, Agent, or Firm*—Bradley N. Ditty

[57] ABSTRACT

An assembly of electric connectors and plug connectors and cap connectors used therein has guiding ribs providing for a smooth joining of the plug connectors and cap connectors, Ribs 16*a,* 16*b and* 16*c extending from the bottom wall* 14 are provided respectively in cavities 6, 8 and 10 of the cap connector 1. All ribs are of the same configuration and have outside surfaces 26, 28 perpendicular to the bottom wall 14, an outside surface 30 parallel to the bottom wall and a slanted surface 20 forming a roughly P-shaped cross section. In the plug connectors, slots of the same configuration as said ribs are formed, thus providing smooth connection by limiting vertical and horizontal deviations during their joining.

19 Claims, 5 Drawing Sheets

Fig. 6
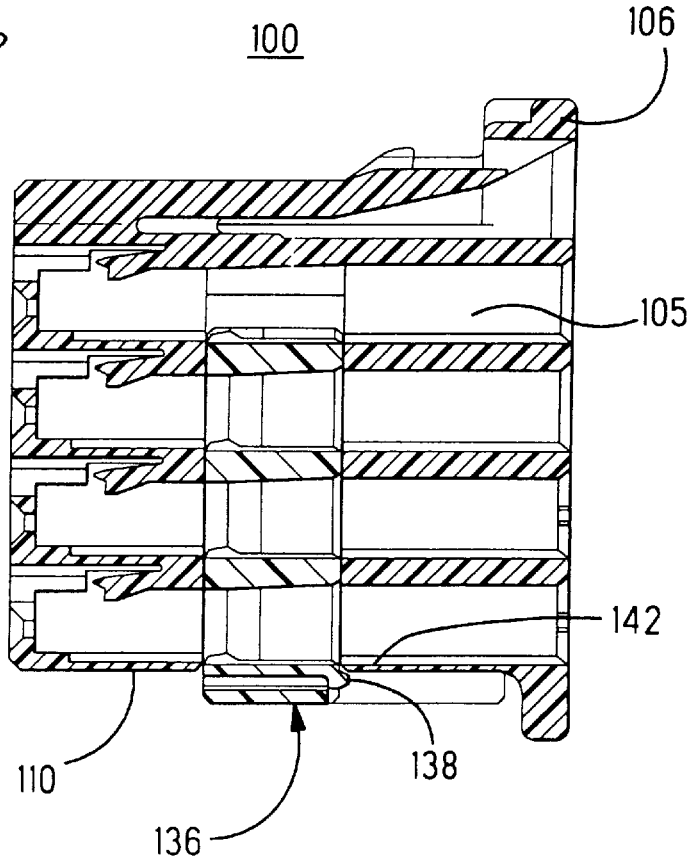
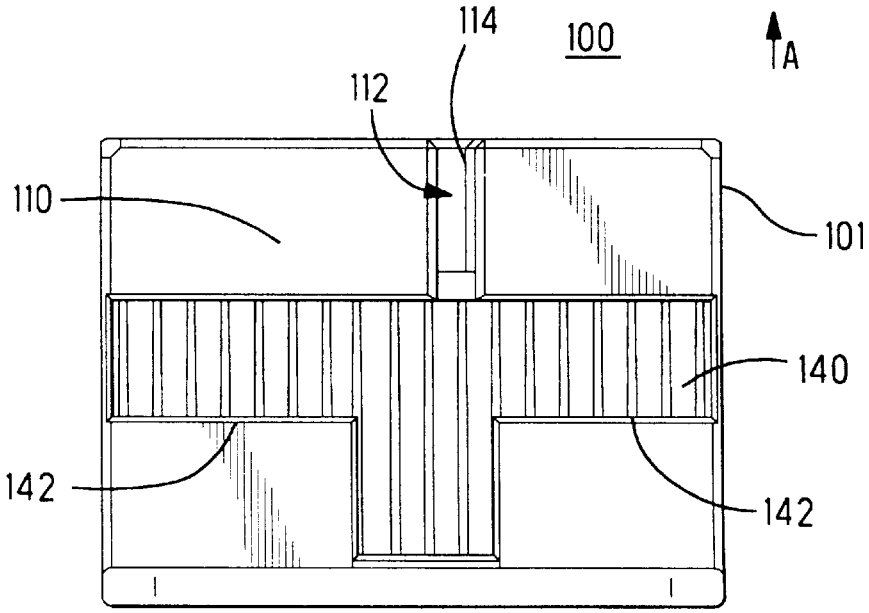
Fig. 7

ASSEMBLY OF PLUG AND CAP ELECTRIC CONNECTORS

BACKGROUND OF THE INVENTION

1. Field of the Invention

This invention relates to assemblies of electric connectors, specifically to connector assemblies having guiding means used at the time of joining or disconnection, as well as to plug connectors and cap connectors used in such assemblies.

2. Description of the Prior Art

It is a well known fact that the failure to properly connect a plug connector with a matching cap connector can result in such problems as bent contacts, etc. Therefore, matching connectors are usually provided with guiding means.

An example of such an assembly of electric connectors is described in Japanese Utility Model Disclosure Sho 61 (1986)-171171 shown in FIG. 11. This assembly of electric connectors 200 consists of a plug connector 202 and a cap connector 220. In the cavity 222 of the cap connector 220 receiving the plug connector 202, a flat rib 226 extending in the direction of the connector insertion is provided on the bottom wall 224. In the plug connector 202, a slot 204 is formed for the reception of the rib 226. At the time of joining connectors 202 and 220, the rib 226 enters the slot 204, thus providing guiding action. In addition, if the cavity 222 is especially wide, additional ribs are provided to prevent the deformation of contacts due to gouging or stubbing.

Since the rib is a narrow flat element of insufficient strength, there is a danger that it can break near the joining plane. Even if several guiding ribs are provided in the connector, some individual ribs still can be easily broken. Conventional ribs do not provide reliable guidance in either vertical or horizontal direction.

SUMMARY OF THE INVENTION

Considering the above mentioned problems, this invention includes an assembly of electric connectors consisting of plug connectors having slots extending in the joining or mating direction and cap or receptacle connectors having ribs inside the cavities intended for the reception of said plug connectors corresponding to above mentioned slots. The purpose of these ribs and slots is to guide of the connectors during their mating and unmating and this connector assembly is characterized by the fact that the slots have a narrow opening and a wide back space connected to said opening. The ribs comprise a base section and end section which are congruent with the above mentioned opening and back space respectively.

A plug connector for the use in the assembly of electric connectors has a guiding slot fitting over the rib formed in cavity of the cap connector into which said plug connector is inserted. The plug connector is characterized by the fact that in the cross section of the above mentioned slot perpendicular to the mating direction has a narrow opening and a wide back space.

A cap or receptacle connector for the use in the assembly of electric connectors has a cavity for the reception of a matching plug connector and a guiding rib arranged in said cavity engaged with the slot formed in said plug connector. The receptacle connector is characterized by the fact that in the cross section of the above mentioned rib perpendicular to the joining direction it has a narrow base section and a wide end section.

BRIEF DESCRIPTION OF THE DRAWINGS

FIG. 6 is a cross section through section 6—6 of the plug connector shown in FIG. 3.

FIG. 7 is a bottom view of the housing of the plug connector shown in FIG. 3.

DETAILED DESCRIPTION OF THE PREFERRED EMBODIMENT

Figure 1:
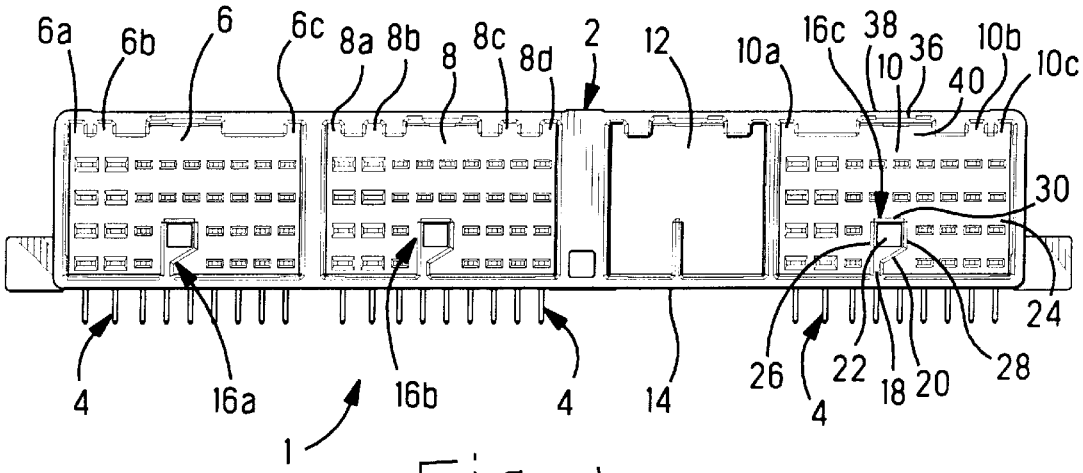
FIG. 1 is a front view of cap connector according to this invention.
Figure 2:
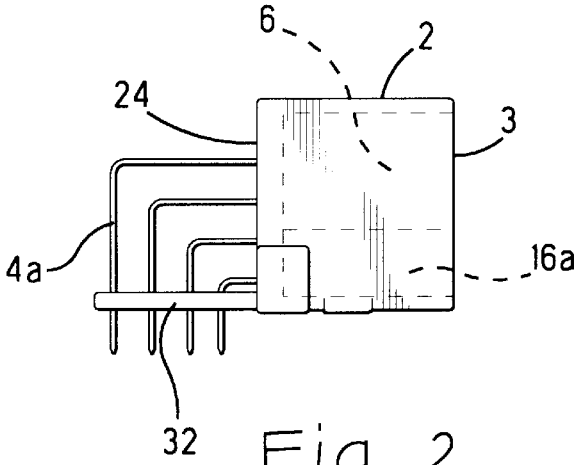
FIG. 2 is a side view of the cap connector shown in FIG. 1.

Below, we will explain embodiments of this invention with reference to attached drawings. FIGS. 1 and 2 represent respectively front view and side view of a cap or receptacle connector 1. The cap connector 1 has a rectangular housing 2 and multiple contacts 4. The cap connector 1 also has cavities 6, 8, 10 for the reception of plug connectors 100 (see FIG. 3). Since the cavity 12 does not have a matching plug connector, it does not have any contacts. In the upper wall 38 of cavities 6, 8, 10, keying slots 6*a*–6*c*, 8*a*–8*c*, 10*a*–10*c* of unique combinations are provided so that only plug connector specifically intended for the specific receptacle or cap connector can be inserted in the cavity. At the bottom wall 14 of the housing 2, ribs 16*a*, 16*b* and 16*c* are made in cavities 6, 8 and 10 as integral parts of the housing. At the front end (at the joining plane or mating face) of these ribs 16*a*, 16*b* and 16*c* color markings are provided, namely, black, gray and green, respectively; otherwise the ribs are of the same configuration. These color codes match the colors of plug connectors intended for their respective cavities.

Since all the ribs 16*a*–16*c* are of the same shape, below we provide explanations concerning only the rib 16*c*. When seen from the front, that is from the side of the joining plane, the rib 16*c* has a shape generally in the form of a distorted letter P. It has a relatively thin and narrow base 18 extending upward from the bottom 14 and a wide tip section 22 which is connected to said base 18 through a slant surface 20. Since the tip section is wide, it can replace several conventional ribs arranged close to each other. The rib 16*c* is connected to the back wall 24 of the cavity 10. The rib 16*c* has a surface 26 which is perpendicular to the bottom wall 14, and the tip section 22 has a surface 28 which is perpendicular to the bottom wall 14 and an upper surface 30 which is parallel to the bottom wall 14. A slot of the same shape as the rib 16*c* provided in the plug connector serves as a guide when the connectors are joined together. Their operation is explained below.

FIG. 2 depicts the housing 2 and a lead plate 32 fixed to the lower part of the back wall 24 of the housing 2. This lead plate 32 determines positions of leads 4*a* of the contacts 4. The rib 16*a* shown by broken lines extends from the joining plane 3 to the back wall 24.

Figure 3:
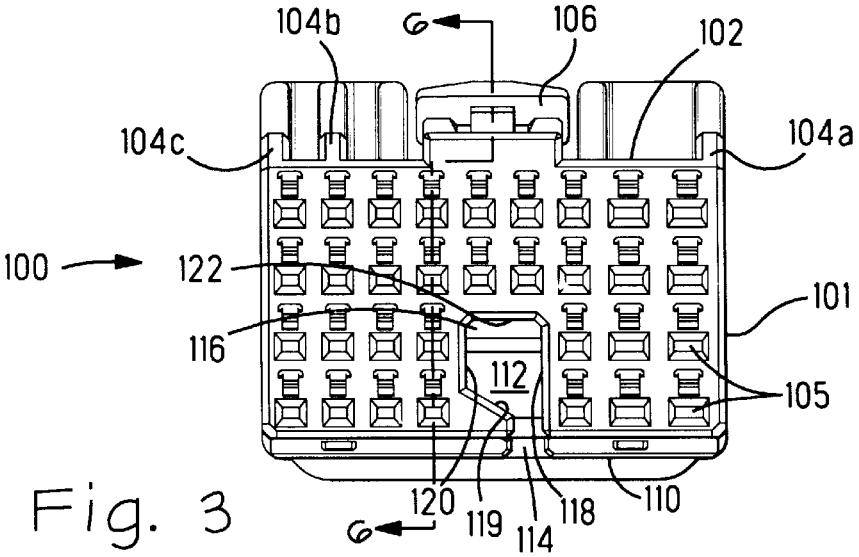
FIG. 3 is a front view of the plug connector intended for the insertion in the cap connector shown in FIG. 1.
Figure 4:
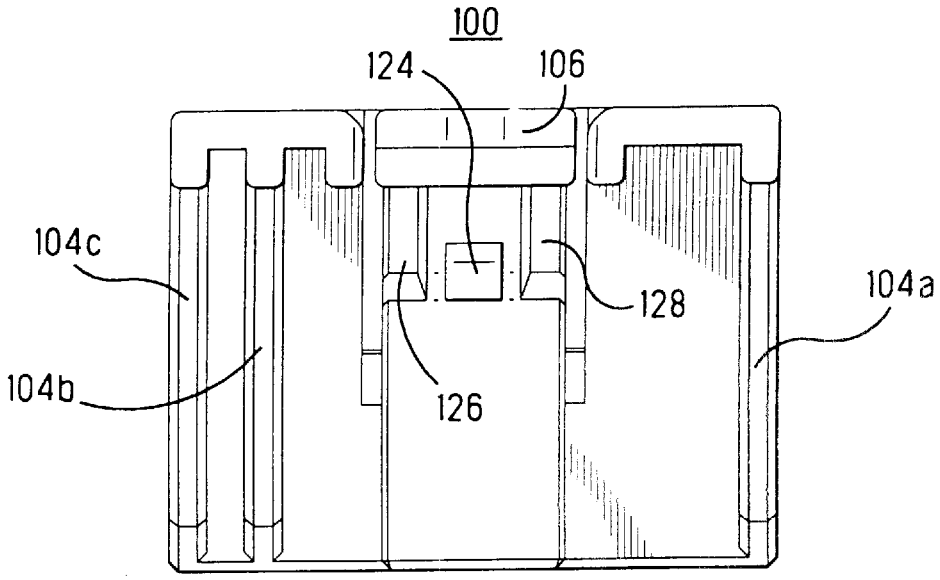
FIG. 4 is a plan view of the plug connector shown in FIG. 3.
Figure 5:
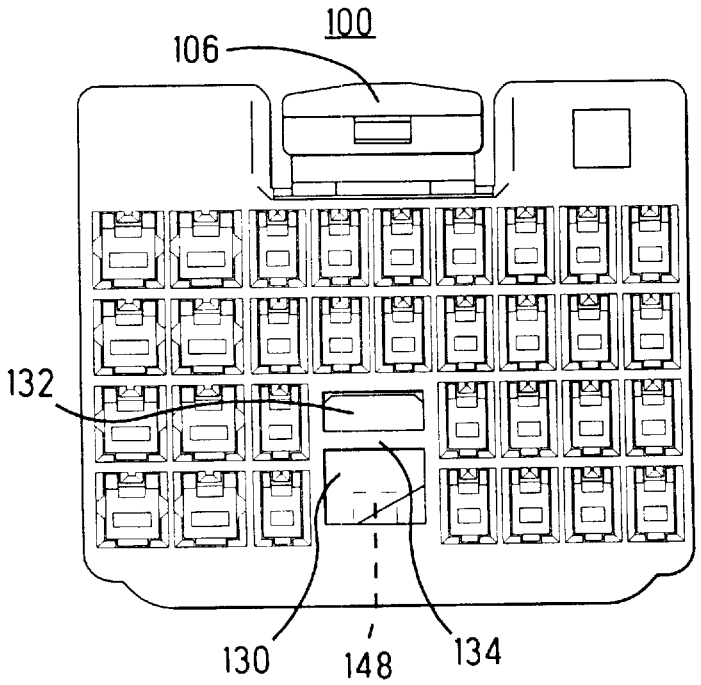
FIG. 5 is a back view of the plug connector shown in FIG. 3.

Explanations concerning the plug connector 100 are provided below with reference to FIG. 3 through FIG. 7. FIG. 3 is front view of the plug connector 100 shown in FIG. 1 which fits in the cavity 10. FIG. 4 is plan view of the plug connector 100 shown in FIG. 3. FIG. 5 is back view of the plug connector 100 shown in FIG. 3. FIG. 6 is a cross section of the plug connector 100 shown in FIG. 3 through section 6—6. FIG. 7 is bottom view of the plug connector 100 shown in FIG. 3.

On the upper wall 102 of the housing 101 of the plug connector 100 shown in FIG. 3, lugs 104*a,* 104*b,* 104*c* are formed which fit in keying slots 10*a,* 10*b* and 10*c* respectively. On the upper wall 102, latch arm 106 is formed which locks the plug connector 100 in the cavity 10 by being engaged with the stopper lug 36 made in the cavity 10. In the plug connector 100, multiple contact cavities 105 corresponding to contacts 4 are made. In these contact cavities 105, other contacts (not shown in the drawing) are arranged whose purpose is to produce connection with contacts 4. Slot 112 extends inside the plug connector 100 from the bottom wall 100. The slot 112 has a narrow opening section 114 and a wide back space 116 of the same configuration as the rib 16*c*. The slot 112 has surfaces 118 and 120 which are perpendicular to the bottom wall 110, and an inside surface 122 which is parallel to the bottom wall. It also has a slanted surface 119. These inside surfaces 118, 120 and 122 interact with outside surfaces 26, 28 and 30 of the rib 16*c* (the same is true for slanted surfaces 119 and 20) to guide the plug connector 100 in the cap connector 1 when these connectors are joined together. Thus, the interaction between inside surfaces 118, 120 and outside surfaces 26, 28 limit left-right deviations, while inside surface 122 and outside surface 30 and slanted surfaces 119 and 20 limit up-down deviations thus providing for a smooth joining of the connectors.

The plan view of the plug connector 100 shown in FIG. 4 depicts configuration of lugs 104*a*–104*c* and the latch arm 106. A protrusion 124 provided on the latch arm 106 engages with the stopper lug 36 of the cavity 10, and lugs 126, 128 fit in the grooves 40 of the upper wall of the cavity 10.

The rear view of the plug connector 100 shown in FIG. 5 depicts a bar 134 made as an integral part of the housing 101 located between two square openings 130, 132. The opening 130 serves as a latch for the secondary stopper to be explained below, and opening 132 is made for weight reduction.

FIG. 6 represents a cross sectional view of the plug connector 100 showing the secondary stopper device 136 whose purpose is to retain contacts. Contacts to be located in contact cavities 105 are not shown in the drawing. In the drawing, secondary stopper device 136 is in interim position, and lug 138 of the secondary stopper device is in contact with the bottom wall 110 of the plug connector 100.

FIG. 7 represents bottom view of the housing 101 of the plug connector 100. The drawing depicts the opening 114 of the slot 112. T-shaped opening 140 in the bottom surface 110 is intended for the above mentioned secondary stopper device 136. Arrow A points in the joining direction of the plug connector 100.

Figure 10:
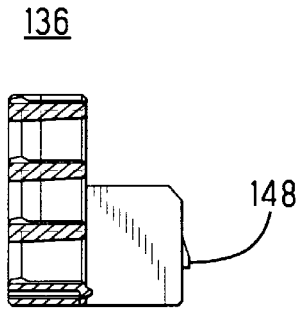
FIG. 10 is a side view of the secondary stopper device in the direction shown by arrow C.
Figure 8:
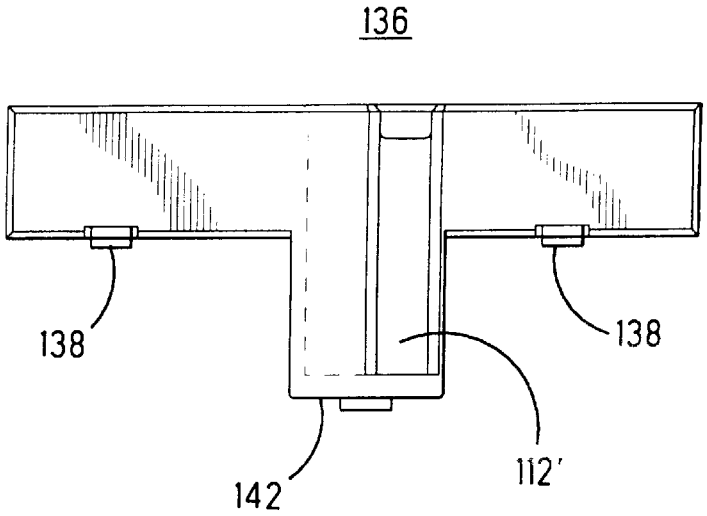
FIG. 8 is a bottom view of the secondary stopper device.
Figure 9:
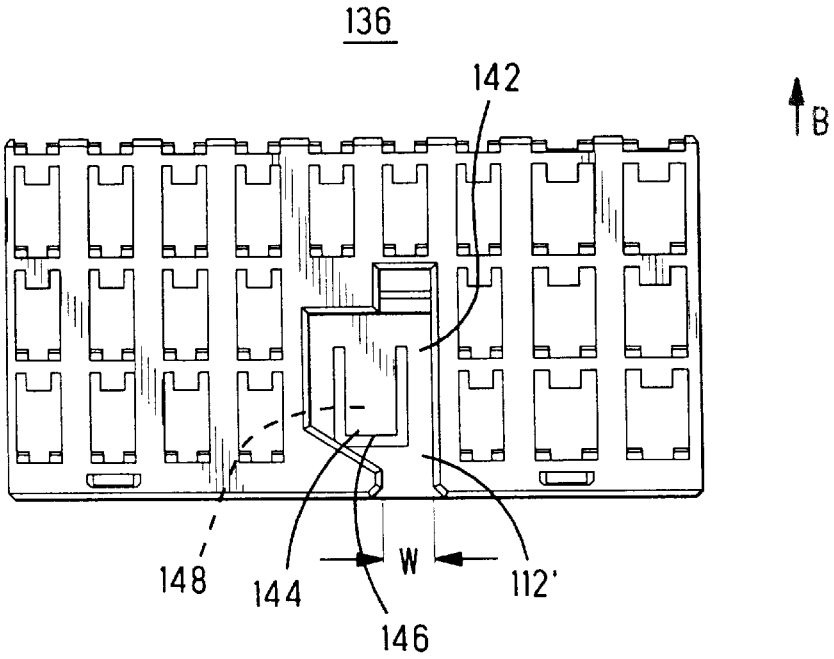
FIG. 9 is a front view of the secondary stopper device.
Figure 11:
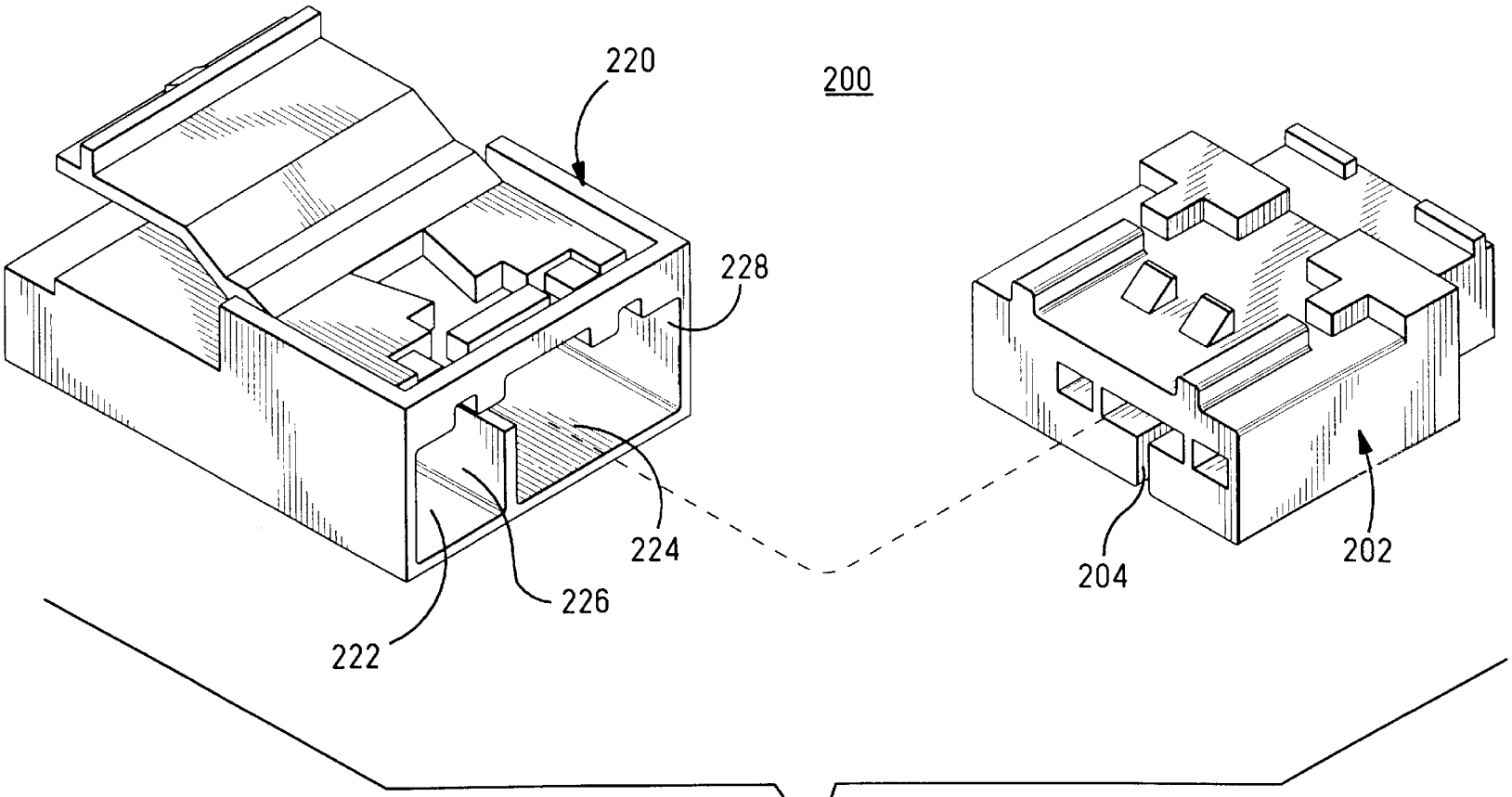
Fig. 11 Prior Art
FIG. 11 is an oblique view of a conventional assembly of prior art electric connectors.

FIGS. 8 through 10 are intended for the explanations of operations of the secondary stopper. FIGS. 8, 9 and 10 are respectively bottom view, front view and a partially sectioned view in the direction shown by arrow C in FIG. 9 of the secondary stopper device 136. As can be seen from FIG. 8, the secondary stopper device 136 has a slot 112' of the same cross section as the slot 112. Slots 112 and 112' are aligned so that rib 16*c* can be inserted through both of them. On the sides of the secondary stopper device 136, lugs 138 are formed. These lugs 138 in the temporary locked position come in contact with edges 142 of the opening 140 of the plug connector 100 (See FIG. 6).

FIG. 9 is front view of the secondary stopper or auxiliary latching device clearly illustrating the configuration of the slot 112'. In the middle of the slot 112', a latch arm 144 is formed at the rear wall 142 of the secondary stopper or latching device. A free end 146 of this latch arm 144 can bend in the perpendicular direction relative to the plane of the drawing. Arrow B indicated the direction of the insertion of the secondary stopper device 136.

Partially sectioned view of the secondary stopper or auxiliary latching device shown in FIG. 10 illustrates lug 148 of the latch arm 144. When the secondary latching device 136 is inserted in the opening 140 in the temporary locked position, this lug 148 becomes latched with the opening 130 in the position shown by broken line in FIG. 5. Because of that, the secondary stopper device becomes locked in the temporary position by lugs 138 latched against the bottom surface 110 and by lug 148 latched in the opening 130. Usually, the width of this latch arm 144 is smaller than the width W of the slot 112. However, because of the wide back space 116, the latch arm can be made wider, thus substantially increasing the strength of the secondary stopper device in the fully locked position.

Above, we have provided detailed explanations concerning the assembly of electric connectors according to this invention and plug and cap connectors used therein, however this invention is not limited only to the embodiments described above, and it is matter of course that various modifications can be made by experts in the field. For example, color coding of the rib 16*c* can be done either by lettering denoting the color or by the color itself. Configuration of the cross section of the rib also can be modified. The tip section may be made round or some other form in the cross section. Furthermore the slot can be located in the cap connector and the mating rib can be located in the plug connector.

The use in the assembly of electric connectors according to this invention and plug and cap connectors used therein of a guiding slot having a narrow opening and a wide back space with a guiding rib of a similar configuration results in the following effect:

The insertion of the plug connector in the cap connector is carried out very smoothly regardless of deviations in horizontal or vertical directions. In addition, due to a large area of the front end of the rib, it is easy to apply color coding of matching connectors.

We claim:

1. An assembly of electric connectors consisting of plug connectors having slots extending in a mating direction and cap connectors having interior cavities for receiving said plug connectors and ribs in the cavities corresponding to the slots on said plug connectors, wherein said slots have a narrow opening in a base wall of the plug connector and a wide back space connected to said opening by a slanted surface and an opposing vertical surface perpendicular to the base wall, and said ribs comprise a base section and a tip section which are congruent with the opening, slanted surface and back space respectively, said ribs and slots guiding said connectors during mating and unmating.

2. The assembly of claim 1 wherein the plug connector slot narrow opening extends to one side of the plug connector housing and the wide back space comprises an enlarged portion of the slot on the interior of the plug connector housing.

3. The assembly of claim 2 wherein inside surfaces of the enlarged portion of the slot and outside surfaces of the tip section of the rib engage to limit lateral left-right misalignment of the plug and cap connectors and to limit perpendicular up-down deviations of the plug and cap connectors during mating and unmating.

4. The assembly of claim 1 wherein the cap connector includes a plurality of side by side cavities, each having ribs with a base section and a wider tip section, individual plug connectors being matable in each of the cavities.

5. The assembly of claim 4 wherein each cavity includes unique keying slots on the opposite side of the cavity from the rib so that unique plug connectors, each having the same slot configuration, can be mated in corresponding cavities of the same cap connector.

6. The assembly of claim 1 wherein each plug connector includes a latch for securing the plug connector in a cavity on the cap connector, the latch being located on the opposite side of the plug connector from the slot.

7. The assembly of claim 1 wherein the plug connector includes a secondary terminal latching member insertable into the housing, the secondary terminal latching member including a secondary slot alignable with the plug connector slot.

8. The assembly of claim 7 wherein each secondary slot includes a narrow opening and a wider back space corresponding to the opening and the back space on the plug connector.

9. The assembly of claim 1 wherein the plug connectors and the cap connectors each include multiple terminal cavities positioned in an array and the slot wide space and rib tip section are located adjacent to the center of the array of terminal cavities.

10. A plug connector for use with a cap connector in an assembly of electric connectors, wherein the plug connector has a guiding slot fitting over a rib formed in a cavity of the cap connector into which said plug connector is inserted, said slot having a cross section perpendicular to the mating direction in which the cross section has a narrow opening at a base wall of the plug connector connected to a wide back space by a slanted surface and an opposing vertical surface perpendicular to the base wall.

11. The plug connector of claim 10 further comprising a secondary terminal latching member insertable laterally into one side of the plug connector housing to provide additional retention for terminals positioned in the plug connector.

12. The plug connector of claim 11 wherein the secondary terminal latching member includes a slot positioned in alignment with the plug connector slot when the secondary terminal latching member is fully inserted into the plug connector housing.

13. The plug connector of claim 12 wherein the secondary terminal latching member slot has a narrow opening and a relatively wider back space having the same dimension as the plug connector slot opening and plug connector slot back space.

14. The plug connector of claim 13 wherein the cap connector rib is insertable through the secondary latching member slot.

15. The plug connector of claim 11 wherein the secondary latching member is insertable into the plug connector in a direction parallel to the slot opening.

16. The plug connector of claim 11 wherein the secondary latching member and the secondary latching member slot extend to the rear of the plug connector.

17. A cap connector for use with a plug connector in an assembly of electric connectors, wherein the cap connector has a cavity for the reception of a mating plug connector and a guiding rib arranged in said cavity engaged with a slot formed in said plug connector, said rib having a cross section perpendicular to the joining direction in which the cross section has a narrow base section at a base surface of the cap connector, the narrow base section connected to a wide tip section by a slanted surface and an opposing vertical surface perpendicular to the base surface.

18. The cap connector of claim 17 wherein the centerline of the rib base section is laterally offset relative to the center of the wide tip section.

19. The cap connector of claim 17 wherein the rib base section has parallel side walls, one of the parallel side walls extending to the top of the wide tip section, the other parallel side wall connected to the slanted surface.

* * * * *